United States Patent [19]

Scantlin

[11] 3,988,015

[45] Oct. 26, 1976

[54] MARKING AND SORTING PROCEDURE

[75] Inventor: John R. Scantlin, Los Angeles, Calif.

[73] Assignee: Transaction Technology, Inc., Los Angeles, Calif.

[22] Filed: Mar. 17, 1975

[21] Appl. No.: 558,912

Related U.S. Application Data

[63] Continuation of Ser. No. 343,813, March 22, 1973, abandoned, which is a continuation-in-part of Ser. No. 223,272, Feb. 3, 1972, Pat. No. 3,802,101.

[52] U.S. Cl. ..... 270/1; 270/58

[51] Int. Cl.[2] ..... B41F 13/54

[58] Field of Search ..... 270/1, 58

[56] References Cited

UNITED STATES PATENTS

| | | | |
|---|---|---|---|
| 3,193,284 | 7/1965 | Kretz, Jr. | 270/53 X |
| R27,298 | 2/1972 | Folino | 270/1 |

*Primary Examiner*—Robert W. Michell
*Assistant Examiner*—V. Millin
*Attorney, Agent, or Firm*—Charles H. Schwartz

[57] ABSTRACT

Method for marking a large number of credit cards with unique credit card numbers. A lot size of plastic sheets is selected which is related to the numerical base, *b*, for expressing the sheet numbers. Each sheet is identically marked with position numbers placed in each of a plurality of uniform credit card areas on each sheet with each area having a position number differing from the position numbers of the other areas on the sheet. Each sheet in the lot is marked with an individual sheet number with sheet numbers being marked by separately marking the individual digits making up the sheet number. After marking the sheets with a digit in the sheet number, the sheets are sorted before marking the next digit. The sorting size is dependent upon the numerical base, *b*, and the order of the digit which has been marked. After sorting, the sheets in each of the sorted groups have the same distribution of sheet numbers. The next digit is then marked on the sheets and the sheets are again sorted, etc., until all the digits of the sheet numbers have been marked. The sheet numbers are marked in each of the uniform credit card areas on each sheet. At the end of the marking procedure, each credit card area, thus, bears a unique credit card number made up of the position number of the credit card area coupled with the sheet number marked on the particular sheet.

16 Claims, 9 Drawing Figures

FIG. 1.
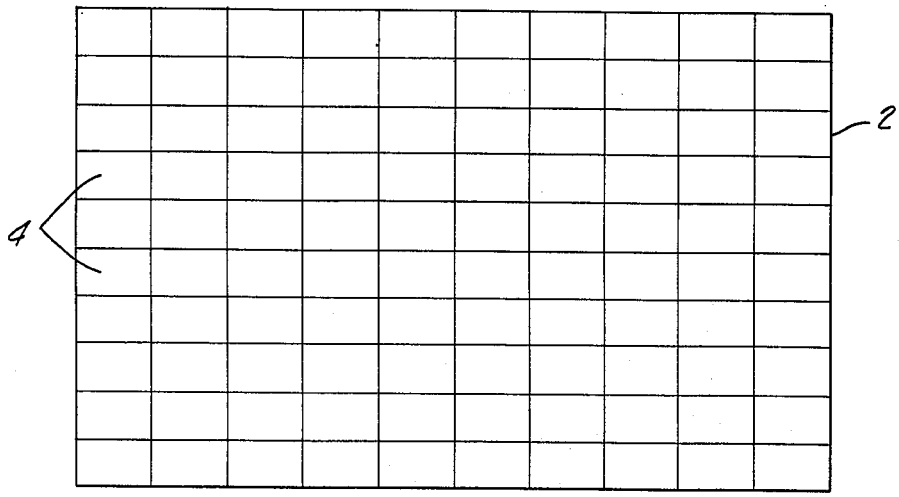
FIG. 2.
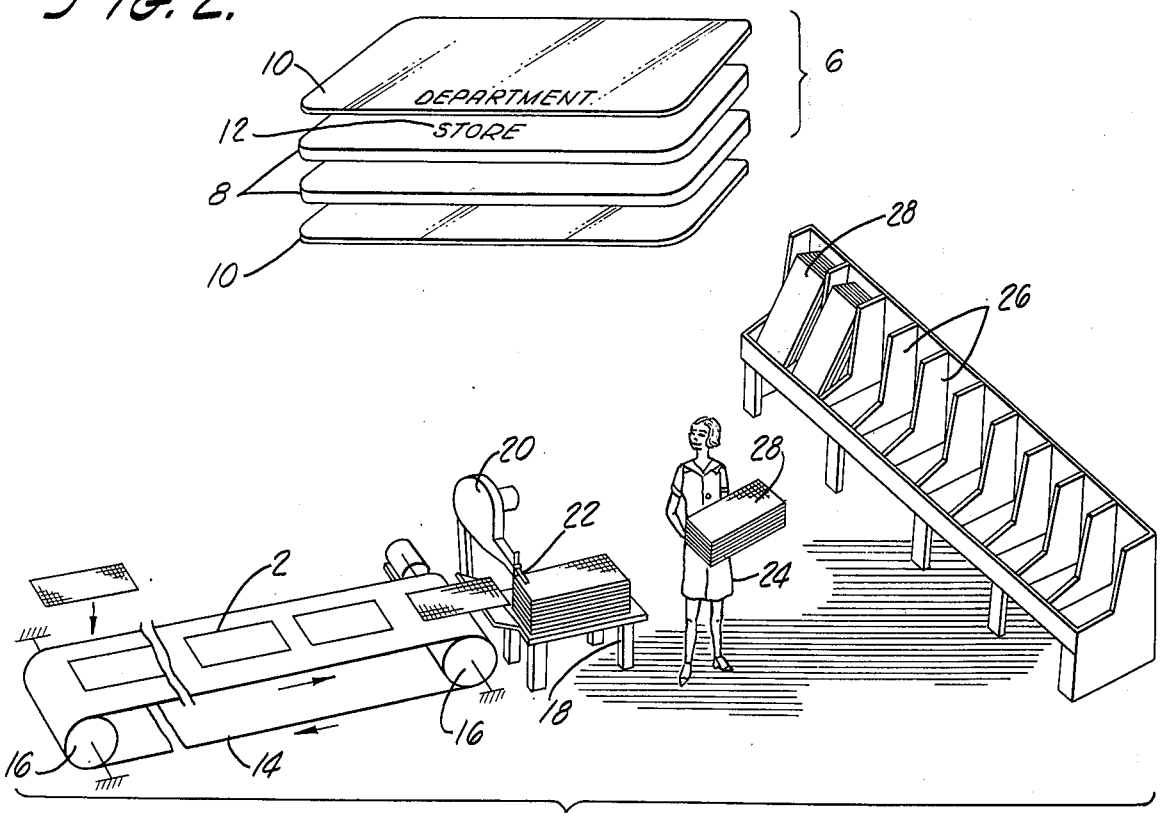
FIG. 3.

FIG. 7. (Printing)

FIG. 8. (Silk Screen Process)

FIG. 9. (Drilling)

MARKING AND SORTING PROCEDURE

Prior Applications

This application is a continuation of application Ser. No. 343,813 now abandoned, filed Mar. 22, 1973, which is a continuation-in-part of my prior copending U.S. Application Ser. No. 223,272 now Patent 3,802,101, filed Feb. 3, 1972, and entitled Coded Identification Card and my U.S. Application Ser. No. 273,434, filed July 20, 1972 and entitled Coded Identification Card and Method.

BACKGROUND OF THE INVENTION

In many industrial operations, it is necessary to sequentially mark a large number of objects as, for example, in providing serial numbers for machine parts, or in printing a large number of individual objects such as credit cards.

One way of making a large number of individual objects is to sequentially mark individual numbers on each of the objects. If there were 1,000 objects, this would involve 1,000 separate marking operations with the number 1 being marked on the first object, the number 2 on the next, etc. until the thousandth object has been marked. This type of marking procedure is cumbersome for mass production operations dealing with very large numbers of objects, such as, the printing of five million credit cards with each having its own individual number.

SUMMARY OF THE INVENTION

In accord with the present invention, I have provided an improved procedure for marking a relatively large number of objects with individual numbers. By sorting the objects in a particular manner, I have found that the total number of marking operations can be substantially reduced. This results in a substantial savings in the overall operation since the sorting procedure constitutes a small portion of the overall operation cost as compared to the marking procedures.

In performing the present method, a large number of objects are marked in a first numerical place with numbers equally distributed over a numerical range and the marked objects are sorted into a plurality of groups with the distribution of numbers in the first numerical place being the same for the objects in each group. Following this, the objects are marked in the second numerical place with the numbers equally distributed over the said same numerical range and the objects are again sorted into groups with the marked objects in each group having the same distribution of numbers in both the first and second numerical places. The method of the invention is completed by marking the objects in succeeding numerical places, e.g., the third, fourth, and fifth places, etc., with the objects being sorted after each marking, except for the last marking, to maintain the distribution of the numerical markings uniform for the objects in each group.

A number of terms are used in describing embodiments of the present process, and for purposes of clarification, these terms are defined at the outset. The term "$b$" refers to the numerical base used for marking a large number of objects. The term "$k$" refers to an integer while the term "$z/b$" refers to a fraction in which $z$ is a whole number smaller than $b$. The maximum lot size of objects to be marked is equal to "$b^n \cdot k$" or "$b^n \cdot z/b$" where "n" is equal to the number of numerical places to be marked.

The term "part" refers to the number of marked objects that are sorted at one time into a single group. The term "group" which may be followed by a numerical notation such as "group (1)" refers to an assemblage of marked objects whose markings are determined by the marking steps which preceded the sorting of marked objects in forming the particular group. The term "groups" which may be followed by a numerical notation such as "groups (3)" refers collectively to the objects in all of the individual groups (3). There are preferably $b$ individual groups in each set of groups such as "groups (1)", "groups (2)", etc., and the markings on the objects in an individual group is identical to the markings on the objects in the other groups in the set.

The term "$n$", in addition to referring to the number of places to be marked, may also be used in referring to a group or groups by use of a general numerical notation such as groups ($n$—2). If, for example, $n$ is 10 because there are 10 numerical places to be marked, then the expression groups ($n$—2) means groups (8). Also, "$n$" may be used in the present description in referring to the order of marking a particular digit. "$n$", when used in this sense, refers to the last numerical place or digit which is marked. Thus, the "$n$th" place in the 10th place if 10 places are required to express the largest number in the lot size while the ($n$—1) place is the 9th place and the ($n$—2) place is the eighth place, etc.

In marking a large number of objects according to the present invention, such as a large number of sheets or cards, the numbers marked on the cards may be expressed according to any convenient numerical base, $b$. A commonly used numerical base is 10. However, depending upon the number of objects to be marked, and the area available on each object for marking, a more convenient numerical base might be a number other than 10, such as 4, 13 or 16. While any numerical base, $b$, may be used in the method of the invention, the numerical base chosen will conveniently range between about 4 and about 16.

After a specific numerical base, $b$, has been selected, the maximum lot size or maximum number of objects to be marked is selected and is equal to $b^n \cdot k$ or $b^n \cdot Z/b$ in which $n$ is a whole number that is greater than one and is equal to the number of places required to express the largest number in a lot $b^n$. For example, the number 1,000 requires four places for expression to the base 10, but only three places according to the base 16 using a hexadecimal notation where it is expressed as 3E8. In the base 16, the letters A through F are substituted respectively for the numbers 10 through 15. Thus 3E8, signifies a number which is equal to $3 \times 16^2 + 14 \times 16^1 + 8 \times 16^0$.

For machine readability, numerical information may be expressed in terms of a binary coded decimal pattern on the object in which the presence or absence of a marking in a particular location indicates the number 1 or 0, in another location, the number 2 or 0, in another location, the number 4 or 0, and still in another location, the number 8 or 0. To express a number, such as 9, by punching holes in the object, a hole is punched in the location designating the number 1 and a hole is punched in the location designating the number 8. No holes are punched in the locations designating the numbers 2 and 4, thus indicating 0's, and the number is, thus, designated as the sum of the numbers 1 and 8. By providing a binary pattern of locations to express individual numbers and then repeating the binary patterns across the object, each binary pattern may be used to express one digit of a larger number. Thus, to express the number 1,298 with the thousands digit representing the $n$th place in the number, and the number 8 representing the units place in the number, the binary pattern indicating the number 8 is punched in the units place, the binary pattern indicating the numbers 1 and 8 in the 2nd location, the binary pattern representing the number 2 in the third location and the binary location indicating the number 1 in the $n$th or thousands place.

After selecting a numerical base $b$ for marking the objects and a maximum lot size of $b^n \cdot k$ or $b^n \cdot z/b$ objects to be marked, the marking operation is commenced by marking the objects with the numerical information to be placed in the 1st place. To illustrate the marking operation, where $k$ or $z/b$ is equal to one, a first run of $b(n^-1)$ objects is marked in the 1st place with a number $c$, a second run of $b^{(n-1)}$ objects is marked in the 1st place with a number $d$, etc. The last run of $b^{(n-1)}$ objects (making a total of $b$ runs) may be marked in the 1st place with a number $h$, with the numbers $c$ through $h$ corresponding in range to the numerical range of numbers 0 to $b$—1.

As the objects are marked in the 1st place with numbers from $c$ through $h$, each of the runs of $b^{(n-1)}$ objects is sorted into b parts with each part containing $b^{(n-2)}$ objects. After this operation is completed, there are $b$ parts of $b^{(n-2)}$ objects in which the number $c$ is in the 1st place, $b$ parts with $d$ in the 1st place, etc., up to and including $b$ parts with $h$ in the 1st place.

The $b$ parts of $b^{(n-2)}$ objects are then combined to form $b$ identical groups (1) of objects with each group (1) containing one part of $b^{(n-2)}$ objects from each of the $b$ runs. Thus, each of the $b$ groups (1) is made up of one part of $b^{(n-2)}$ objects having $d$ in the 1st place, etc. and one part of $b^{(n-2)}$ objects having $h$ marked in the 1st place.

After sorting the marked objects into $b$ groups which are termed groups (1), as described above, the $b$ groups (1) are then sent to a second marking operation for marking the numbers from $c$ to $h$ in the 2nd place. This is accomplished by marking the number $c$ in the 2nd place on the objects in one of the groups (1), the number $d$ in the 2nd place on the next group (1), the number $e$ in the 2nd place in the next group (1), etc. until the last group (1) is marked in the 2nd place with the number $h$.

Either after or during the marking of the objects in the 2nd place with numbers from $c$ through $h$, the groups (1) which have been marked in the 2nd place are sorted into $b^2$ parts. For example, the first group (1) which is marked with the number $c$ in the 2nd place is subdivided into $b^2$ parts with each part containing $b^{(n-3)}$ objects marked in the 2nd place with the number $c$. Of these $b^2$ parts, $b$ identical parts of $b^{(n-3)}$ objects each will have $c$ marked in the 2nd place and $c$ in the 1st place, $b$ identical parts of $b^{(n-3)}$ objects each will have $c$ marked in the 2nd place and $d$ in the 1st place, etc. and $b$ identical parts of $b^{(n-3)}$ objects each will have $c$ marked in the 2nd place and $h$ in the 1st place.

After dividing each of the groups (1) which has been marked in the 2nd place into $b^2$ parts, the parts are sorted and rearranged to form $b$ groups (2) with each group (2) containing one of $b$ identical parts of $b^{(n-3)}$ objects from each of the groups (1). Each group (2) is, thus, identical and contains a total of $b^{(n-1)}$ objects made up of $b^2$ parts with $b^{(n-3)}$ objects in each part.

After sorting the objects into groups (2) of $b^{(n-1)}$ objects, as described above, the groups are marked in the 3rd place with numbers ranging from $c$ to $h$. The first group (2) is marked with $c$ in the 3rd place, the next with $d$ in the 3rd place, etc., until the $b$ or last group (2) is marked in the 3rd place with $h$.

The groups (2) are then each divided into $b^3$ parts of $b^{(n-4)}$ objects each. For example, the first group (2) which is marked with $c$ in the 3rd place contains $b$ identical parts of $b^{(n-4)}$ objects each with $c$ marked in the 3rd place, $c$ in the 2nd place and $c$ in the 1st place; $b$ identical parts of $b^{(n-4)}$ objects with $c$ in the 3rd place, $c$ in the 2nd place, and $d$ in the 1st place and so on to $b$ identical parts of $b^{(n-4)}$ objects with $c$ in the 3rd place, $h$ in the 2nd place and $h$ in the 1st place. This makes a total of $b^3$ parts with each part containing $b^{(n-4)}$ objects.

As described, each group (2), after being marked in the 3rd place, contains $b^3$ parts of objects with each part containing $b^{(n-4)}$ objects. Thus, in forming $b$ groups (3), one of $b$ identical parts of $b^{(n-4)}$ objects is placed in each of the groups (3) and this operation is repeated until all of the $b^3$ parts are sorted into $b$ identical groups (3). This operation is repeated b times in sorting all of the objects in the $b$ groups (2).

The above-described operation is repeated, as necessary to mark $b^n$ objects, by marking the groups (3) in the 4th position with numbers from $c$ to $h$, then dividing each group (3) into $b^4$ parts with each part containing $b^{(n-5)}$ objects. The $b^4$ parts in each group (3) are then sorted into identical $b$ groups (4) by placing one of $b$ identical parts into each of $b$ groups (4) and repeating this operation $b^3$ times until all of the $b^4$ parts are sorted. This entire operation is repeated b times in sorting the objects in all of the $b$ groups (3).

As the process proceeds, succeeding groups are formed by sorting preceding groups into an increasing number of parts of objects with each part containing fewer and fewer objects. The final sorting step of the process occurs in sorting the groups ($n$—2) to form groups ($n$—1). For example, if 1,000,000 sheets are marked with numbers from 000000 to 999999 using 10 as the base $b$, then $n$ is equal to 6 and the groups ($n$—2) are the groups (4) and the groups ($n$—1) are the groups (5). Using this example, when the groups ($n$—2) are marked in the first to the last remaining place, or ($n$—1) place, the $b^{(n-1)}$ or 100,000 objects in the first group ($n^-2$) will range in number from $b$ or 10 objects numbered 00000 to $b$ or 10 objects numbered 09999 while those in the second group ($n$—2) will range from 10 objects numbered 10000 to 10 objects numbered 19999, etc. Each of the groups ($n$—2) is then sorted into $b^{(n-1)}$ or $10^5$ parts with each part containing $b^0$ or one object. The final sorting operation, then, involves sorting one of b identically marked objects into each of b groups ($n$—1) or 10 groups (5). This operation is repeated $b^{(n-2)}$ or $10^4$ times in sorting all the objects in one group (4) and the entire operation is repeated $b$ or 10 times in sorting the objects in all of the $b$ or 10 groups (4).

After this sorting operation, each group (5) contains $b^{(n-1)}$ or 100,000 objects which are marked with numbers from 00000 to 99999. The groups ($n$—1) are then marked by placing the numbers 0 to $b$—1 in the nth place, i.e., the last remaining place. The first of the groups ($n$—1) is marked with the number 0 in the $n$th place, the next with 1 in the nth place, and the next with 2 in the $n$th place, etc., until the $b$ group ($n-1$) is marked with the number $b-1$ in the $n$th place. At this point, the marking operation is completed. A total of $b^n$ objects has, thus, been successively marked with numbers from 0 to ($b^{n-1}$) with a total of $n \times b$ marking steps employed. The objects in the first of the groups ($n-1$) may be numbered from 0 to $b^n/b - 1$; the objects in the second group ($n-1$) are numbered from $b^n/b$ to ($2b^n/b$) $-1$, etc. and the objects in the $b$ or last group ($n-1$) are numbered from ($b-1$) $b^{(n-1)}$ to $b^n-1$.

The mathematical relationships in the above described procedure may be simplified in terms of the general relationship between the group numbers, i.e., groups-1,2,3, etc.; the number of parts formed from each group in going to the succeeding group; the number of objects in each part; the base $b$, and the number $n$ required to express the largest number in the lot size, i.e., $b^n-1$. Groups (1) are formed from $b^1$ parts of $b^{(n-2)}$ objects; groups (2) are formed from $b^2$ parts of $b^{(n-3)}$ objects, groups (3) from $b^3$ parts of $b^{(n-4)}$ objects, and groups ($n-1$) from $b^{(n-1)}$ parts with each part containing one object. In progressing from one group such as group (1), to another, such as group (2), the number of parts increases in each case by a factor of $b$ while the number of objects in a single part decreases by a factor of $1/b$. Thus, the product of the number of parts and the number of objects in each part is always equal to $b^{(n-1)}$ and $b^{(n-1)}$ is also the number of objects in each of the successive groups (1), groups (2), etc.

When the number of objects to be marked is a multiple of $b^n$ objects, such as $b^n \cdot k$ where $k$ is an integer, or a fraction of $b^n$, such as $b^n \cdot z/b$ where $z$ is a whole number that is smaller than $b$, the overall process is conducted in the same general manner as that indicated where $k$ or $z/b$ are equal to one. If $k$ is an integer, the entire marking and sorting procedure may be modified simply by introducing the factor $k$ into the procedure. Thus, the marking operation then proceeds by marking a first run of $b^{(n-1)} \cdot k$ objects in the 1st place with a number $c$, a second run of $b^{(n-1)} \cdot k$ objects in the 1st place with a number $d$, etc. and the last run of $b^{(n-1)}$ . $k$ objects in the 1st place with a number $h$ with the numbers $c$ through $h$ corresponding in range to the numerical range of numbers from 0 to $b-1$.

The $b$ parts of $b^{(n-2)} \cdot k$ objects are then combined to form $b$ identical groups (1) of objects with each group (1) containing one part of $b^{(n-2)} \cdot k$ objects from each of the $b$ runs. Thus, each of the $b$ groups (1) is made up of one part of $b^{(n-2)} \cdot k$ objects having $c$ in the 1st place, one part of $b^{(n-2)} \cdot k$ objects having $h$ marked in the 1st place.

As the process proceeds, identically marked groups (2) are formed from $b^2$ parts of $b^{(n-3)} \cdot k$ objects; identically marked groups (3) from $b^3$ parts of $b^{(n-4)} \cdot k$ objects, and lastly groups ($n-1$) from $b^{(n-1)}$ parts with each part containing $b^0 \cdot k$ or $k$ objects. After the final marking step in which the $n$th place is marked, each of the $b$ groups contains $b^{(n-1)} \cdot k$ marked objects with each part of $k$ objects in each group being identically marked. Thus, the end result when $k$ is an integer greater than one is equivalent to repeating the process $k$ times when $k$ is equal to one.

When the number of objects to be marked is a fraction of $b^n$, such as $b^n \cdot z/b$, the process is modified by introducing the factor $z/b$ into the process. Thus, the marking of $b^n \cdot z/b$ objects begins by marking a first run of $b^{(n-1)} \cdot z/b$ objects in the 1st place with a number $c$, a second run of $b^{(n-1)} \cdot / z/b$ objects in the 1st place with a number $d$, etc. and the last or $b$ run of $b^{(n-1)} \cdot z/b$ objects with a number $h$ with the numbers $c$ through $h$ corresponding in numerical range to the numbers 0 through $b-1$.

The $b$ parts of $b^{(n-2)} \cdot z/b$ objects are then combined to form $b$ identical groups (1) of objects with each group (1) containing one part of $b^{(n-2)} \cdot z/b$ objects from each of the $b$ runs. Thus, each of the $b$ groups (1) contains one part of $b^{(n-2)} \cdot z/b$ objects having $c$ in the 1st place, etc., and one part of $b^{(n-2)} \cdot z/b$ objects having $h$ marked in the 1st place.

As the process proceeds, identically marked groups (2) are formed from $b^2$ parts of $b^{(n-3)} \cdot z/b$ objects; identically marked groups (3) from $b^3$ parts of $b^{(n-4)} \cdot z/b$ objects until the groups (n−2) are formed from $b$ ($n-2$) parts with each part containing $z$ objects. The objects in the groups ($n-2$) are then marked in the ($n-1$) or first to last numerical place and the marked objects are then sorted by sorting one of $z$ identically marked objects into each of $z$ identical groups ($n-1$) which each contain $b^{(n-1)}$ objects. The marking operation is then completed by marking the nth place (last numerical place) of the objects in the first group ($n-1$) with the number $c$, the nth place on the objects in the second group ($n-1$) with the number $d$, the nth place on the objects in the third group ($n-1$) with the number $e$, and so on until the objects in the $z$ group ($n-1$) are marked in the $n$th place with the number $f$. The numbers $c$ through $f$ correspond in numerical range to the numbers 0 through $z$.

The net result in carrying out the process where $z/b$ is a fraction less than one is that a fractional part, i.e., $z/b$, of the entire process is carried out when the entire process is viewed as the situation where $z/b$ equals 1. To illustrate, where $b^n$ is equal to $10^3$ or 1,000 and $z/b$ is equal to 3/10, the objects marked according to the process will be in 3 groups. If the numbers $c, d, e, f$, etc. correspond to 0, 1, 2 . . . 9, the objects in the first group will be marked with the numbers 000 to 099, those in the second group with the numbers 100 to 199, and those in the third group with the numbers 200 to 299. If the process was then repeated, for example, with $z/b$ being equal to 7/10, the objects could be marked with numbers from 300 to 999 to complete the numerical sequence of 000 to 999. The net result of conducting the process in this manner would be that 3/10ths of the overall process would be carried out at one time with 7/10ths of the overall process being carried out at a separate time.

BRIEF DESCRIPTION OF THE DRAWINGS

In illustrating an embodiment of the invention, reference is made to the drawings wherein:

FIG. 1 is a plan view of a plastic sheet having areas indicated thereon which are used to form credit cards;

FIG. 2 is an exploded view of a credit card having core sheets on which numerical information is imprinted and FIG. 3 is a pictorial view depicting a card procedure in which marked sheets are received from a conveyor, counted, and then sorted into a plurality of bins;

FIG. 7 is a schematic view of an offset printing mechanism as may be employed in marking objects according to the present process;

FIG. 8 is a schematic view of a silk screen apparatus as may be employed in marking objects according to the present process, and FIG. 9 is a schematic diagram which illustrates the use of a drill for marking objects in accord with the present process.

DETAILED DESCRIPTION

Figure 4:
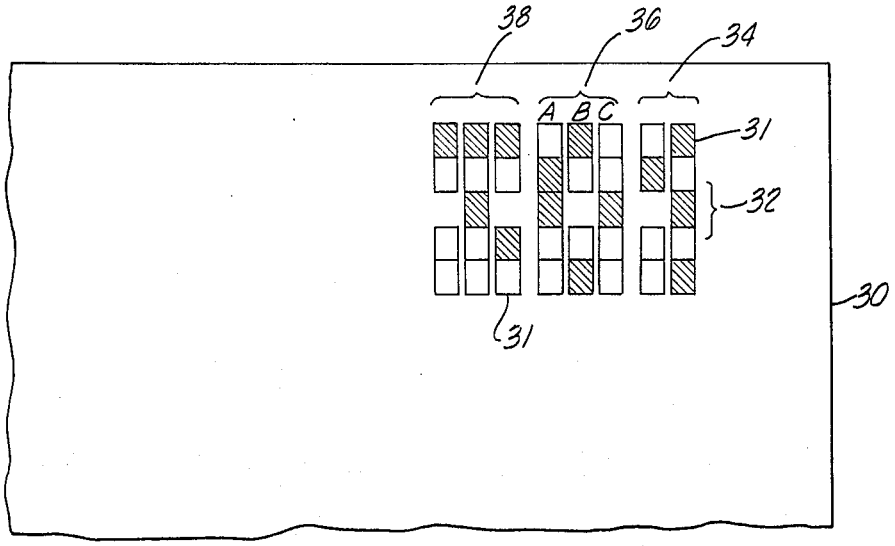
FIG. 4 is a plan view of a credit carrd sheet portion illustrating the placement of markings thereon to give the sheet portion a specific number.

FIG. 1 illustrates a plastic sheet 2 having 100 areas 4 indicated thereon. One application for the method of the present invention is in marking numerical information on credit cards which are formed from sheets of plastic. A large number of credit cards may be formed from a single sheet. Thus, the areas 4 in FIG. 1 depict the size of individual credit cards with respect to the sheet 2 from which they are subsequently cut after being marked to provide an individual number on each credit card.

The construction of a credit card 6 is illustrated in exploded view in FIG. 2. As shown, the card 6 may be formed of two core sheets 8 and two cover sheets 10. Encoded numerical information may be placed on the inner surface of the core sheets 8 to alter the transmissivity of the credit card to radiant energy at the locations where the numerical information is placed. The core sheets 8 may then be laminated together with the cover sheets 10 to form a composite structure.

Indicia 12, such as printed information concerning the credit card issuer, etc., may be imprinted on the outer surface of one of both of the core sheets 8. The indicia 12 is then protected from wear by the cover sheets 10 which provide a smooth outer surface.

In marking and sorting sheets according to the present process, as shown in FIG. 3, sheets 2 may be marked at a marking station (not shown) and then transported on a conveyor belt 14 that is supported by rolls 16. The sheets 2 are, thus, conveyed to a stacking table 18. As the sheets 2 are stacked on the table 18, they are counted by an automatic counting device 20 which inserts a marker such as a slip of paper 22 between each ten sheets, one-hundred sheets, etc. as the case may be. A worker 24 then removes the counted sheets 28 from the table 18 where they are sorted into a plurality of bins 26.

FIG. 4 illustrates a credit card sheet portion 30 having areas 31 thereon which are marked to give the portion a specific number. As illustrated, some of the areas 31 may be darkened, as by placing ink on the areas through a suitable printing procedure, while other of the areas 31 are not darkened. The presence or absence of ink on the areas 31 is one means of encoding binary information on the portion 30.

To determine the numerical information on the sheet portion 30 as illustrated in FIG. 1, the portion may be inserted into a readout device when incorporated into a completed credit card, as discussed in my prior copending U.S. application Ser. No. 276,768, filed July 31, 1972. A clock track may be placed on the portion 30 as indicated by the darkened areas designated 32, as described in my prior applications Ser. No. 242,382, filed Apr. 10, 1972, and Ser. No. 276,768 to activate light sensors in a readout device which determines the number on the portion 30.

As illustrated, the areas 31 are positioned in vertical alignment to form a series of vertical columns across the sheet portion 30. Excluding the areas designated 32 for the clock track, each of the vertical columns contains four areas which may be used to impress a binary coded number on the card. For example, the vertical column at the right-hand edge of the card is darkened in the area adjacent the card's upper edge, the next area is blank, the area following the clock track 32 is blank, and the last area is darkened. The uppermost area in the column may represent the numbers 0 or 1 and can represent the number 1 since the area is darkened. The succeeding area may represent the number 0 or 2 because the area is not darkened. Proceeding down the column, the next area may represent the number 0 or 4 and represents 0 because the area is not darkened. The lowermost area may represent either 0 or 8 and represents 8 because the area is darkened. Thus, the number 9 is indicated in the first column as the sum of 1 and 8.

Proceeding to the next column to the left, the darkened area indicates the number 2. Thus, the number designated in the two right-hand columns referred to by reference numeral 34 is the number 29.

Conveniently, a large number of credit cards are formed from a single sheet of plastic material. Thus, one sheet of plastic material may supply material for 100 credit cards. To designate the number of a credit card in terms of its position on the sheet, each sheet may be printed with numbers from 00 to 99 to specifically designate each of the 100 cards on that sheet. These numbers may be indicated in the columns designated as 34 in FIG. 4. Thus, the number 29 appearing in column 6 may designate this sheet portion 30 as the 29th card on the sheet.

The areas 31, as indicated in FIG. 4, may have a different transmissivity to radiant energy than the balance of the sheet portion 30 to indicate a number when a card containing portion 30 is illuminated by a radiant energy source. Sensors positioned adjacent to the card detect the radiant energy levels at the areas 31 which may be higher or lower than the level for the balance of the card. Numerical information may also be indicated on a card by drilling holes in the card at selected areas with the holes transmitting radiant energy at higher levels than the balance of the card. Also, magnetic material may be placed in selected areas on the card to indicate numerical information. In short, the present method is not restricted to any particular physical means for marking numerical information on objects, such as cards, nor is it restricted to the use of any particular marking pattern, such as a binary pattern, marking the information.

Referring again to the sheet portion 30 in FIG. 4, the next three columns A, B and C, which are denoted collectively by a reference numeral 36, may be used to designate the particular sheet number from which the card will be formed. Thus, for example, if the numerical base *b* used for marking numerical information on the card is the number 10, the three columns A, B and C may be used to respectively designate the hundreds column, the tens column and the units column individually marking 1,000 sheets with numbers ranging from 000 to 999. The numerical information on sheet portion 30 using a binary pattern, as described previously, indicates that the portion 30 is on sheet 290 and will be card 29 formed from that sheet.

In forming a large number of credit cards, each marking lot of, e.g., 1,000 sheets, may be marked with an individual lot number indicating the particular lot from which the cards were formed. Three columns, denoted collectively as 38 in FIG. 4, may be used to indicate the lot number. In the sheet portion 30, as illustrated, the lot number is 115 and the card number will, thus, be 115-290-29.

Figure 5:
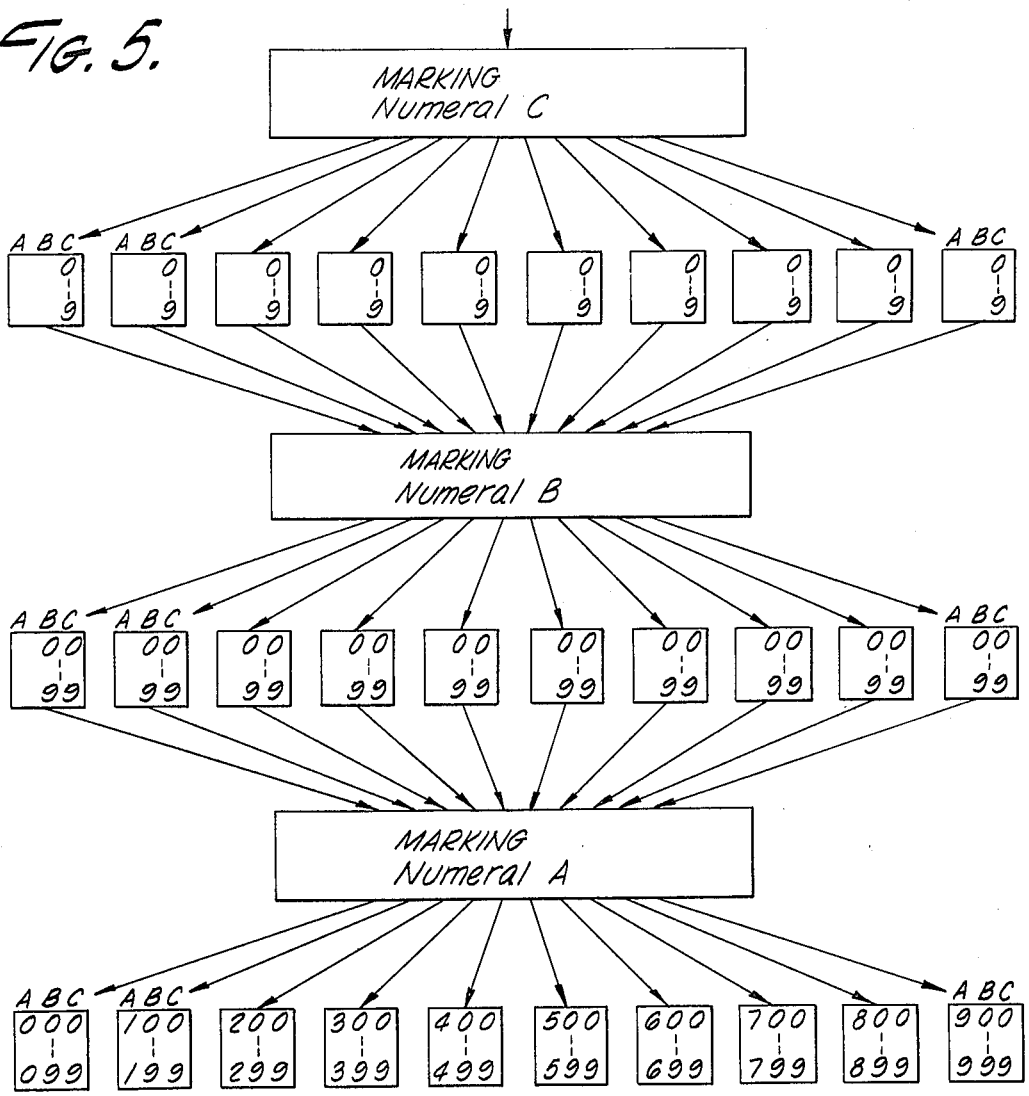
FIG. 5 is a flow diagram which illustrates a marking and sorting procedure for marking 1,000 objects with individual numbers from 000 to 999 using the fewest number of marking steps.

Turning to FIG. 5, there is shown a schematic flow diagram for marking 1,000 sheets with numbers from 000 to 999. Assuming that the numerical base $b$ for marking the 1,000 sheets is the number 10, the sheets are marked in the columns designated A, B and C with the first sheet marked 000 and the last sheet marked 999. In expressing the number 999 to the base 10, three places are required. The number indicated in column C is the first numerical place while the number indicated in the last numerical place in column A is in the nth numerical place and the number indicated in column B is in the $(n-1)$ numerical place.

In using the process of the present invention, the numerical base $b$ used for marking the objects may be any convenient number and preferably ranges from about 8 to about 16. The number of places, $n$, required to express the maximum number in a lot size of $b^n \cdot k$ or $b^n \cdot z/b$ objects will vary depending upon the particular numerical base $b$ which is selected. However, in all cases, the maximum number of objects in the lot size chosen for marking will be equal to $b^n \cdot k$ or $b^n \cdot z/b$ when using the process of the present invention.

In marking $b^n \cdot k$ or $b^n \cdot z/b$ objects using the present process, the first marking steps involve marking the number $c$ through $h$ covering the numerical range of 0 to $(b-1)$ in the 1st place. Using the base 10, as in the procedure shown in FIG. 5, where the maximum lot size is equal to $10^3$ or 1,000 objects, the 1st place may be represented by the column C.

In marking the numbers 0 to 9 in the C place on 1,000 sheets, the sheets are divided into runs of $b^{(n-1)}$ or 100 sheets. After subdividing the total lot of 1,000 sheets into 10 runs of 100 sheets, each of the runs is separately marked with a number between 0 and 9 to provide 100 sheets with 0 marked in the C place, 100 sheets with 1 in the C place, etc., up to and including 100 sheets with $(b-1)$ or 9 in the C place. This requires a total of $b$ marking runs, i.e. 10 marking runs, to mark all of the 1,000 sheets in the C place at a marking station 40.

As each of the runs of 100 sheets is marked in the C place, each of the runs is sorted into $b$ parts, i.e., 10 parts, with each part containing $b^{(n-2)}$ sheets or 10 sheets. Each of the 10 parts from each of the 10 runs is then separately sorted into 10 bins denoted by reference numeral 42. Thus, when the marking operation at station 12 has been completed, each of the ten bins 42 contains 100 sheets with 10 sheets having 0 marked in the C place, 10 sheets with 1 in the C place, 10 sheets with 2 in the C place, etc., up to and including 10 sheets with 9 in the C place. The groupings of $b^{(n-1)}$ or 100 sheets in each of the $b$ or ten bins 42 are termed groups (1) in describing the present process. Each of the $b$ groups (1) in each of the $b$ bins 14, contains one part of $b^{(n-2)}$ objects from each of the $b$ runs. Thus, each of the groups (1) is made up of one part of $b^{(n-2)}$ objects having 0 in the 1st place, one part of $b^{(n-2)}$ objects having 1 in the 1st place, etc., up to and including one part of $b^{(n-2)}$ objects having $(b-1)$ marked in the 1st place.

After sorting the sheets into $b$ groups (1), the groups (1) are then sent to a second marking station 44 for marking the numbers from 0 to $(b-1)$ in the 2nd place. In the example illustrated, the 2nd place may be denoted by the column B and the numbers marked in that column range from 0 to 9. At the marking station 44, the number 0 is marked in the B place for one of the groups (1), the number 1 is marked in the B place for another of the groups (1), etc, until the number 9 is marked in the B column for the last group (1).

After marking each of the groups (1) in the B or 2nd place with a number from 0 to $b-1$ or 9, each of the groups (1) that has been marked is sorted into $b^2$ or 100 parts of $b^{n-3}$ or one sheet each. The $b^2$ or 100 parts are then sorted by placing one of $b$ identically marked parts, i.e. one sheet at a time, into each of ten bins 46 and repeating the operation until all the parts are sorted. When the marking operations have been completed at marking station 44, each of the bins 46 contains $b^{(n-1)}$ or 100 sheets formed of $b^2$ or 100 parts of $b^{(n-3)}$ or one sheet to thereby provide identically marked sheets from 00 to 99 in each of the bins 46. The objects or sheets in the bins 46 are termed groups (2) in describing the present process.

After sorting the sheets to form groups (2) in bins 46, the sheets are then moved to a third marking station 48 for marking numbers from 0 to $b-1$ or 9 in the A or $n$th place. This is accomplished by taking a first group (2) from a bin 46 and marking the number 0 in the A place on the sheets. The sheets are then placed in a bin 50. The operation is repeated by taking a second group (2) from a bin 46, marking the number 1 in the A place, and placing the sheets in a second bin 50, etc., until all of the sheets in the groups (2) have been marked with the last group (2) being marked in the A place with the number 9.

At this point, the marking operation is complete with each of the bins 50 containing $b^{(n-1)}$ sheets. The sheets are numbered from 000 to 099 in the first bin 50, 100 to 199 in the second bin 50, 200 to 299 in the third bin 50, etc., up to and including 900 to 999 in the last bin 50.

Figure 6:
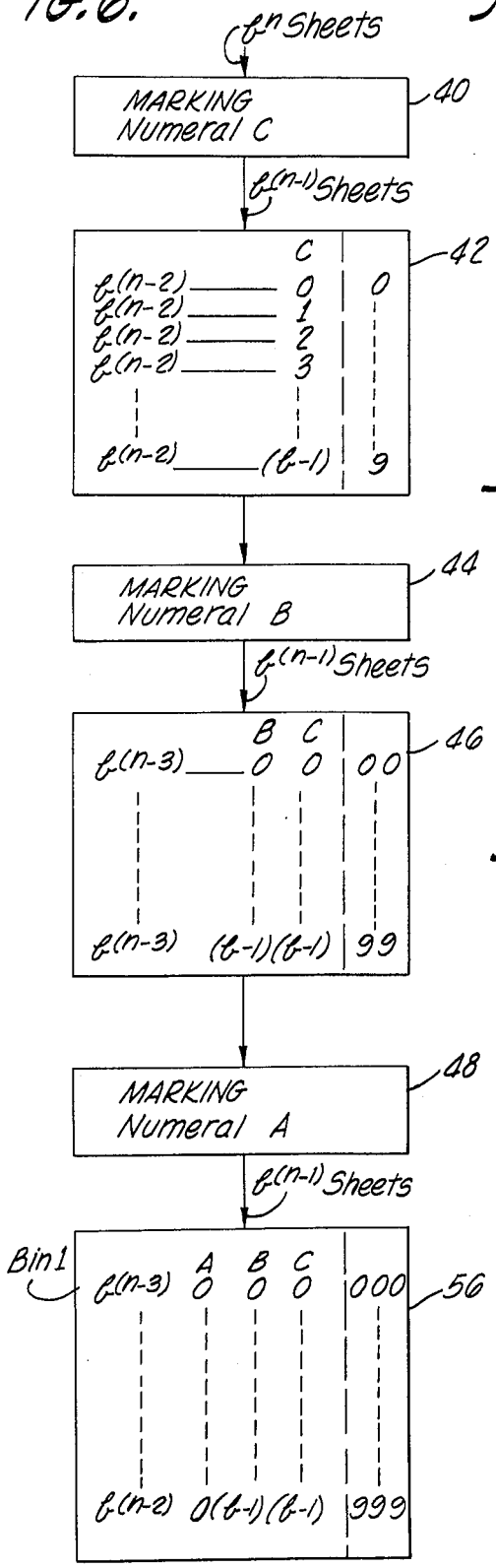
FIG. 6 is a flow diagram which illustrates more specifically the sorting procedures involved in marking a given number of sheets with consecutive numbers using the fewest number of marking steps.
Figure 6:
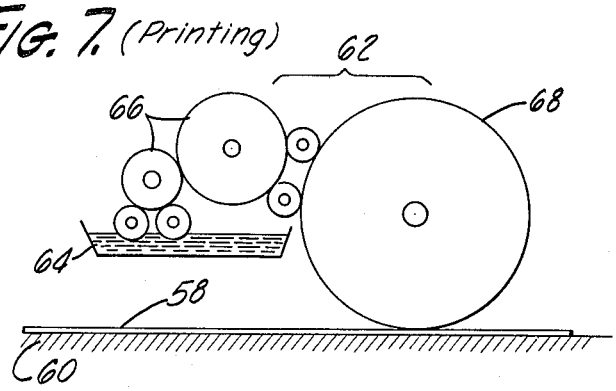
Figure 6:
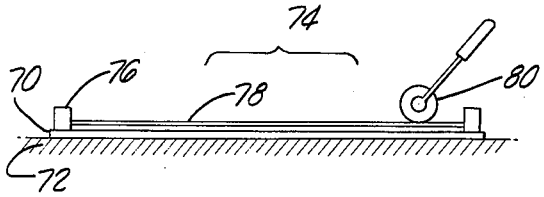
Figure 6:
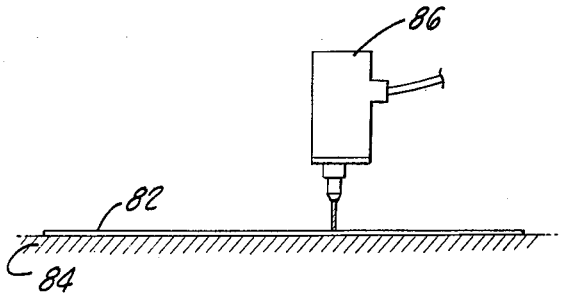

FIG. 6 illustrates a flow diagram which demonstrates more specifically the flow path of sheets during the marking and sorting operation generally illustrated in FIG. 5. As shown, $b^n$ sheets are fed to the marking station 40 for marking numbers from 0 to 9 in the C place. After the marking operation at station 40 is completed, each of the bins 42 contains a group (1) of $b^{(n-1)}$ marked sheets. As shown, bin 42 contains $b$ parts of marked sheets with each part containing $b^{(n-2)}$ sheets marked respectively in the C position with numbers from 0 to $b-1$, or 0 to 9 in the procedure illustrated in FIG. 5.

After all the sheets have been marked at marking station 40, they are then moved to marking station 44 in the manner described previously for marking the numerals 0 to $b-1$ in the B or 2nd position. After this is accomplished, each of the marked groups (1) is sorted into $b^2$ or 100 parts of $b^{(n-3)}$ or one sheet. Then one part of each of $b$ identically marked parts is sorted, i.e., one sheet at a time, into the bins 46 as shown in FIG. 5. As shown, each bin 46 contains a group (2) of $b^{(n-1)}$ sheets composed of $b^2$ or 100 parts with each part comprising $b^{(n-3)}$ or one sheet.

Each of the groups (2) has $b^{(n-3)}$ or one sheet with 0 in the B place and 0 in the C place, one sheet having 0 in the B place and 1 in the C place, etc., up to and including one sheet having $b-1$ or 9 in the B place and $b-1$ or 9 in the C place. Thus, the sheets in each bin 46 range in number from 00 to 99.

After the marking operation at station 44 is completed, the groups (2) are then marked at station 48 with numbers from 0 to $b-1$ or 9 in the A position. As described previously, the sheets are not sorted after being marked in the $n$th or A place at marking station 48. The first of the groups (2) which is marked at marking station 48, is shown in a Bin 1 denoted by the reference numeral 56 in FIG. 3. As shown, all of the $b^{(n-1)}$ or 100 sheets in Bin 1 have the number 0 marked in the $n$th or A position. The $b^{(n-1)}$ sheets have, however, the same distribution of numbers in the B and C positions described previously for Bin 46. Thus, the sheets in Bin 1 range in number from 000 to 099.

The second group (2) of $b^{(n-1)}$ sheets marked at station 48 have the same distribution shown in Bin 1 except that the sheets are marked with the number 1 in the A position. Similarly, as the operation is repeated, each of the sheets in the third group (2) will have the number 2 in the A position, etc., and each of the sheets in the $b$ or 10th group (2) will have the number $b-1$ or 9 marked in the A position.

As described, one lot of 1,000 sheets has been marked with numbers from 000 to 999 in a total of $b \times n$ or 30 separate marking steps. The 1,000 sheets are equal to a maximum lot size of $b^n$ sheets in which $b$ is the arithmetic base used to express the numbers in the marking operation and $n$ is the number of places required to express the largest number in the lot size being marked.

As stated previously, the present process is not limited to any particular means for marking objects. By way of illustration, FIG. 7 depicts an offset printing operation in which a sheet 58 is placed on a support 60 as information is printed thereon by an offset printing apparatus 62. Ink 64 is conveyed through a plurality of transfer rollers 66 to a printing roll 68 which engages the surface of the sheet 58.

Another means of marking objects is silk screening as illustrated in FIG. 8 in which sheet 70 on a support 72 has a marking applied thereto by a silk screening apparatus 74. The apparatus 74 includes a frame 76 having a screen 78 and a squeegee or ink applicator 80 which forces ink through selected portions of the screen 78 into contact with the sheet 70.

Still another means of marking is illustrated in FIG. 9 in which a sheet 82 positioned on a support 84 has holes drilled therein by a drill 86. The drill 86 may, for example, be very accurately positioned by a mounting head (not shown) to drill holes at precise locations in the sheet 82. Similarly, the sheet 82 may be marked by using a number of drills which are operated in unison to simultaneously drill holes in the sheet.

For ease of description, the present process has been illustrated in terms of marking 1,000 objects in 30 separate marking operations. However, it should be understood that the process has general application to marking any lot size of objects containing a maximum of $b^n \cdot k$ or $b^n \cdot z/b$ objects.

In marking objects having a maximum lot size of $b^n$ objects, the 1st place is marked with numbers from $c$ to $h$ corresponding in numerical range to the numbers 0 through $b-1$. As described, each of the runs of $b^{(n-1)}$ objects is sorted into $b$ parts with each part containing $b^{(n-2)}$ objects. The parts of $b^{(n-2)}$ objects are then combined to form $b$ identical groups (1) with each group (1) containing one part of $b^{(n-2)}$ objects from each of the $b$ runs. The $b$ groups (1) are then sent to a second marking operation for marking numbers from $c$ to $h$ in the 2nd place. After this marking operation, each group (1) is sorted into $b^2$ parts of $b^{(n-3)}$ objects and the parts are combined to form $b$ identical groups (2) of $b^{(n-1)}$ objects.

By repeating the above-described marking and sorting procedure to form groups (3) with $b^3$ parts of $b^{(n-4)}$ objects, groups (4) of $b^4$ parts of $b^{(n-3)}$ objects, etc., depending on the number of places $n$ that is required to express the largest number in a lot size of $b^n$ objects, the objects are sorted into identical $b$ groups $(n-2)$. After marking the groups $(n-2)$ in the first to the last or $(n-1)$ place, the groups $(n-2)$ are divided into $b^{(n-1)}$ parts in which each part contains $b^0$ or one object. Each of the parts of identically marked objects is then sorted by placing one of $b$ identical parts, i.e., one object, in each of $b$ groups $(n-1)$ and repeating the sorting operation until all of the parts have been sorted into $b$ identical groups $(n-1)$. The identical groups $(n-1)$, thus, each contain $b^{(n-1)}$ parts of $b^0$ objects, i.e., $b^{(n-1)}$ separately marked objects. In the example previously illustrated, $b$ groups $(n-1)$ was expressed as ten groups (2) since the numerical base was 10 and $n$ was equal to 3 for a lot size of 1,000 sheets. However, if the numerical base had been 16 and $n$ had been equal to 10, $b$ groups $(n-1)$ would be expressed as 16 groups (9).

After sorting the objects into $b$ groups $(n-1)$, the first of the groups $(n-1)$ is marked with $c$ in the nth place, the next group $(n-1)$ with $d$ in the $n$th place, etc., until the last of the groups $(n-1)$ is marked with $h$ in the $n$th place. This completes the marking and sorting procedure with $b^n$ objects being marked from 0 to $b^n-1$, in $b \times n$ marking steps. Referring to the use of the base 16 with $n$ equal to 10, $b^n$ would be equal to $16^{10}$ and the total number of marking steps required would be $16 \times 10$ or 160.

In performing the present process, where the maximum lot size is $b^n$ objects, the number of objects in a part decreases by a factor of $1/b$ as successive groups are formed from preceding groups. The term part, as used herein, refers to the number of objects that are sorted into a single group or a single bin. Thus, when there are 10 objects in a part, this means ten objects are sorted at one time into each group or bin.

In its preferred form, the present process requires sorting each group separately as it is marked. Thus, assuming a lot size of $b^n$ objects, the first step involves dividing the $b^n$ objects into $b$ first portions of $b^n/b$ objects each. As the first of the $b$ first portions is marked, it is sorted into smaller portions of $b^n/b^2$ objects which are placed equally in each of $b$ bins to form identical second portions. This operation is repeated for each of the other $b$ portions and the bins then each contain $b^n/b^2$ objects from each of the first portions.

The objects in the $b$ bins are then marked in the next place with numbers from $c$ to $h$ corresponding in numerical range to the numerical range of 0 through $b-1$ and as the objects in each bin are marked they are sorted by placing portions of $b^n/b^3$ objects in each of a second set of $b$ bins to form third portions of objects. To illustrate, as $b^n/b^3$ objects are marked with $c$ in the 2nd place from the first bin of the first set of bins, they are sorted into the first bin of the second set of $b$ bins.

The next $b^n b^3$ portion is sorted into the second bin of the second set and so on to the $b$ bin in the second set and then back to the first bin of the second set and through to the $b$ bin again. This is continued until all of the objects in the first bin of the first set are marked and sorted. Then the objects in the second bin of the first set are marked with $d$ in the 2nd place and sorted in the same manner and so on until all of the objects in the first set of bins have been marked in the 2nd place and sorted into the second set of $b$ bins.

The whole operation is repeated in marking the 3rd place on the objects in the second set of bins and, as they are marked, the objects are sorted into the first set of $b$ bins. The portions which are sorted contain $b^n/b^4$ objects.

As the marking operation proceeds, the size of the portions which are sorted ultimately reaches $b^n/b^n$ so that the objects are sorted one at a time. When this sorting has been completed, the objects, which are now all marked in the first to the last or $(n-1)$ place and are in either the first or second set of bins, are marked in the last or $n$th place. The objects in the first bin are marked with $c$ on the $n$th place, those in the second bin with $d$ in the $n$th place, and those in the $b$ bin with $h$ in the $n$th place. This completes the marking and sorting operation.

An even simpler way of carrying out the present process using a maximum lot size of $b^n$ objects is to separately mark runs of $b^{(n-1)}$ objects with numbers from $c$ to $h$ and to sort the objects one at a time into $b$ bins as they are being marked. The objects are marked in the same sequence, as previously described. After each marking, they are sorted one at a time into each of $b$ bins instead of being sorted in portions of $b^n/b$, $b^n/b^2$, $b^n/b^3$, etc. Sorting the objects one at a time into $b$ bins produces the same final result since each of the portion sizes $b^n/b$, $b^n/b^2$, etc., is divisable by $b$. However, it is less efficient to sort one object at a time, even though this simplifies the process by not having to reduce the size of the succeeding portions which are sorted.

In practicing the present process the maximum lot size may be a multiple of $b^n$ as represented by $b^n \cdot k$ where $k$ is an integer larger than one or a fraction of $b^n$ as represented by $b^n \cdot z/b$ where $z$ is an integer less than $b$. If the maximum lot size is $b^n \cdot k$, the factor $k$ is introduced into the process by marking runs of $b^{(n-1)} \cdot k$ objects in the first place with numbers $c$ through $h$ corresponding to the numeral range of 0 through $b-1$. The objects are then sorted into $b$ identical groups (1) by placing one part of $b^{(n-2)} \cdot k$ identically marked objects in each of the groups (1).

As the process proceeds, $b$ groups (2) are formed from $b^2$ parts of $b^{(n-3)} \cdot k$ objects; $b$ groups (3) are formed from $b^3$ parts of $b^{(n-4)} \cdot k$ objects, etc. After marking the groups $(n-2)$ in the $n-1$ place, $b$ identical groups $(n-1)$ are formed which contain $b^{(n-1)}$ parts of $b^0 \cdot k$ objects. The process is then completed by marking the $n$th place of the objects in the first group $(n-1)$ with $c$, the next with $d$, etc., and the last or b group with $h$.

In practicing the present process when the maximum lot size is a fraction $z/b$ of $b^n$, the factor $z/b$ is carried through the process up to the formation of the groups $(n-1)$. Thus, runs of $b^{(n-1)} \cdot z/b$ objects are marked in the first place with numbers $c$ through $h$ corresponding in range to the numerical range of 0 through $b-1$. The objects are then sorted into $b$ identical groups (1) by placing one part of $b^{(n-2)} \cdot z/b$ into each of the groups (1). Groups (2) are formed from $b^2$ parts of $b^{(n-3)} \cdot z/b$ objects, etc., until $b$ groups $(n-2)$ are formed from $b^{(n-2)}$ parts of $z/b$ objects. The objects in the groups $(n-2)$ are then marked in the $n-1$ place with the numbers $c$ through $e$ and are sorted one object at a time into $z$ identical groups $(n-1)$. The marking operation is then completed by marking the $n$th place on the objects in the groups $(n-1)$ with numbers $c$, $d$, $e$, etc., corresponding in numerical range to 0 to $z$.

In the foregoing description, the largest number $b^n-1$ in a lot size of $b^n$ objects has been described conventionally in terms of reading the number from left to right, e.g., 1,029 is one thousand twenty-nine. The number $b^n-1$ could, however, also be expressed from right to left, top to bottom or reading sequentially outward from the center of the number toward its extremities, e. g., 12109, would be ten thousand, two hundred ninety-one. In short, the numerical information can be expressed in any manner providing it is read in the same manner.

As described previously, the process may be practiced by marking the numbers $c$ to $h$ in the 1st place, then the numbers $c$ to $h$ in the 2nd place, etc., with the $n$th place denoting the last digit in the total number, e.g., one in the thousands place is the last digit in 1,291 and 2 is in the $n-1$ or first to the last place. It is not necessary, however, that the $n$th place be the place denoting the last number or that the $(n-1)$ place be adjacent to the $n$th place, etc. The $n$th place, as used in describing the present process, merely refers to the last place number which is marked in expressing the largest number $b^n-1$ in a lot size $b^n$. For example, the number 1,976,421 expressed to the base 10 requires 7 places for expression. Thus, the $n$th place is the 7th place which is marked, i.e., after marking the other six places. However, the $n$th place need not be the last place to the left which expresses the number one million. It could be the second place from the left denoting the number 900,000 or the sixth place from the left denoting the number 20. Assuming the $n$th place to be the second place from the left denoting the number 900,000, the $n-1$ place does not have to be adjacent to the $n$th place but could be any of the remaining places. Likewise, the $n-2$ place doesn't have to be adjacent to the $n-1$ place, etc. After all of the places have been marked, in accord with the present process, the last remaining place or $n$th place is marked with numbers from $c$ to $h$ and the marking operation is completed by using a total of $b \times n$ marking steps. When the maximum lot size is $b^n \cdot k$, as described previously, the number of marking steps is equal to $b \times n$ as in the case where the maximum lot size is $b^n$. However, when the maximum lot size is $b^n \cdot z/b$, the number of marking steps is equal to $b(n-1) + z$.

When the marking steps of the process are carried out by randomly selecting the first place, the second place, the $n-1$ place, the $n$th place, etc., as described above, the marked objects will be arranged randomly at the end of the marking operation. Thus, it is preferable that the $n$th place not be randomly chosen but be the last numerical place in the number $b^n-1$ (however, the number $b^n-1$ is read, e. g., right to left or left to right, etc.). Likewise, it is preferable that the $n-1$ place be the first to the last numerical place, and $n-2$ be the second to last numerical place, etc. By practicing the method in this manner, the marked objects may be sequentially arranged at the end of the marking operation rather than being randomly arranged.

As described previously, the present method may be used to mark sheets such as sheets of plastic used in forming credit cards. Flat objects, such as sheets, are more readily sorted than odd-shaped objects and are more adaptable to marking by the present process. However, odd-shaped objects may also be marked since the steps involved in the present process are not dependent on the shape of the objects. Also, the use of bins, as previously described, is not essential to the present process since the objects being marked may be sorted by any convenient means.

As previously described, the numbers $c$, $d$, $e$, $f$, $g$, $h$, etc., correspond to the numerical range of 0 to $b-1$. As an example, if $b-1$ is 9, the numerical range of 0 to 9 includes 10 numbers. To provide this numerical range, the numbers $c$ through $h$ could, for example, range consecutively from 5 through 14 or from 3 to 30 if each number was a multiple of 3. However, it is not necessary that the numbers $c$, $d$, $e$, etc., are actually 0, 1, 2, etc., up to $b-1$.

For a maximum lot size of $b^n$ objects, it is not necessary that the numerical system chosen for marking include all the numbers from 0 to $b^n-1$. For example, the numerical base $b$ and the number of places $n$ to express the number $b^n-1$ could be chosen to provide twice as many numbers as are needed in going from 0 to $b^n-1$ with only the odd or even numbers then being used for marking. Thus, $n$ represents the number of numerical places required to express a number $b^n-1$ or a whole multiple of $b^n-1$. Also, for example, the numerical system chosen could arbitrarily exclude certain numbers by beginning the marking sequence with a number greater than zero and ending with a number greater than $b^n-1$. As illustrated previously in FIG. 4, by using four areas 31 in each of the columns across the sheet portion 30, any number from 0 to 15 may be expressed as the sum of the darkened areas 31 in a particular column. Thus, the numerical base $b$ chosen for a marking operation using the binary pattern on the sheet portion 30 could be as high as 16, i. e., numbers from 0 to 15 in each column, or could be any number less than 15, e. g., the base 8 with numbers from 0 to 7 in each column or the base 10 with numbers from 0 to 9 in each column.

I claim:

1. A method for marking a large number of plastic sheets to define a plurality of individual uniform credit card areas on said sheets by marking each credit card area with a unique credit card number, said method comprising:

selecting a numerical base, $b$, for marking the plastic sheets;

selecting a lot size of sheets to be marked which lot size is substantially equal to $b^n \cdot k$ sheets in which $k$ is an integer and $n$ is a whole number greater than one and is equal to the number of places required to express the number $b^{(n-1)}$ or a multiple of $b^{(n-1)}$ in terms of the numerical base $b$;

identically marking each sheet in the lot with position numbers in each of the plurality of uniform credit card areas on each sheet with each credit card area on a sheet having an individual position number which differs from the position number of each of the other credit card areas on the sheet;

marking each sheet in the lot with an individual sheet number;

said sheet number being marked in each of the plurality of uniform credit card areas on each sheet;

said sheet numbers being marked on the sheets in the lot by marking the 1st numerical place of the sheet number on a first run of $b^{(n-1)} \cdot k$ sheets with a number $c$;

marking the 1st place of the sheet number on a second run of $b^{(n-1)} \cdot k$ sheets with a number $d$;

marking the 1st place of the sheet number on succeeding runs of $b^{(n-1)} \cdot k$ sheets with numbers, $e$, $f$, $g$, etc., until the last or b run of $b^{(n-1)} \cdot k$ sheets is marked in the 1st place of the sheet number with a number h with the range of the numbers $c$ through $h$ corresponding to the numerical range of numbers 0 to $b-1$;

forming $b$ groups (1) of sheets marked in the 1st place of the sheet number by placing one part of $b^{(n-2)} \cdot k$ sheets marked with $c$ in the 1st numerical place into each of the $b$ groups (1), then placing one part of $b^{(n-2)} \cdot k$ sheets marked with d in the 1st numerical place into each of the b groups (1), etc., until one part of $b^{(n-2)} \cdot k$ sheets marked with $h$ in the 1st numerical place is placed in each of the $b$ groups (1) with each group (1) being identical and containing b parts of $b^{(n-2)} \cdot k$ sheets with one part from each of the $b$ runs and each group (1) containing a total of $b^{(n-1)} \cdot k$ sheets;

marking the 2nd numerical place of the sheet number on the sheets in one of the groups (1) with the number $c$;

marking separately the sheets in succeeding groups (1) in the 2nd place of the sheet number with the same numbers $d$, $e$, $f$, $g$, etc., used in marking the 1st place with numbers until the last group (1) is marked in the 2nd place of the sheet number with the same number $h$ used in marking the last run of sheets in the 1st numerical place;

forming $b$ identical groups (2), $b$ identical groups (3), $b$ identical groups (4) and so on until $b$ groups ($n-2$) are formed by repeating the above procedure with each of the groups (2) formed by combining $b^2$ parts of $b^{(n-3)} \cdot k$ sheets from the marked groups (1), each of the groups (3) formed by combining $b^3$ parts of $b^{(n-2)} \cdot k$ sheets from the groups (2) and each of the groups (4) formed by combining $b^4$ parts of $b^{(n-5)} \cdot k$ sheets from the groups (3) and so on;

marking the $n-1$ numerical place of the sheet number on the sheets in the groups ($n-2$) with numbers from $c$ to $h$ with the first group ($n-2$) marked with $c$, the next with $d$ and so on until the $b$ group ($n-2$) is marked with $h$ in the $n-1$ place;

dividing each marked group ($n-2$) into $b^{(n-1)} \cdot k$ parts with each part containing $b^0 \cdot k$ sheets;

sorting each of $b$ identical parts of $b^0 \cdot k$ sheets from each of the groups ($n-2$) into each of $b$ identic... groups ($n-1$), and then marking the $n$th numerical place of the sheet number on the sheets of each of the groups ($n-1$) with succeeding numbers from $c$ to $h$ to provide $b^n \cdot k$ sheets which are marked with individual sheet numbers corresponding to the numerical range from 0 to $b^n-1$ by using a total of $b \times n$ marking steps and by reducing the sorting size after each marking operation by a factor of $1/b$ as compared with the sorting size used in the preceding marking operation.

2. The method of claim 1 wherein the numerical base $b$ ranges from about 4 to about 16.

3. The method of claim 1 wherein the credit card areas are marked by screen printing.

4. The method of claim 1 wherein the credit card areas are marked by altering the transmissivity of said sheets at selected areas on the sheets.

5. The method of claim 1 including the steps of providing a number of bins which is equal or greater than the numerical base, and sorting the sheets into $b$ bins after each marking by placing one of $b$ identical parts into each of the $b$ bins.

6. The method of claim 5 wherein the number of bins is at least equal to twice the numerical base $b$, and including:

sorting the sheets into a first series of $b$ bins after marking of one numerical place of the sheet number of the sheets;

marking the next numerical place of the sheet number on sheets drawn from the first series of $b$ bins, and then sorting the thus marked sheets into the second series of $b$ bins by placing one of $b$ identical parts into each of the $b$ bins in the second series of $b$ bins.

7. The method of claim 1 wherein the sheets are alternatively sorted between a first series of $b$ bins and a second series of $b$ bins after marking of each numerical place of the sheet number on the sheets.

8. The method of claim 1 wherein the credit card areas are marked by forming holes at selected locations in the sheets.

9. A method for marking a large number of plastic sheets to define a plurality of individual uniform credit card areas on each sheet by marking each credit card area with a unique credit card number, said method comprising:

selecting a numerical base, $b$, for marking the plastic sheets;

selecting a lot size of sheets to be marked which lot size is substantially equal to $b^n \cdot z/b$ sheets in which $z$ is a whole number smaller than $b$ and $n$ is a whole number greater than one and is equal to the number of places required to express the number $b^{(n-1)}$ or a multiple of $b^{(n-1)}$ in terms of the numerical base $b$;

identically marking each sheet in the lot with position numbers in each of the plurality of uniform credit card areas on each sheet with each credit card areas on a sheet having an individual position number which differs from the position number of each of the other credit card areas on the sheet;

marking each sheet in the lot with an individual sheet number;

said sheet number being marked in each of the plurality of uniform credit card areas on each sheet;

said sheet numbers being marked on the sheets in the lot by marking the 1st numerical place of the sheet number on a first run of $b^{(n-1)} \cdot z/b$ sheets with a number $c$;

marking the 1st place of the sheet number on a second run of $b^{(n-1)} \cdot z/b$ sheets with a number $d$;

marking the 1st place of the sheet number on succeeding runs of $b^{(n-1)} \cdot z/b$ sheets with numbers $e, f, g$, etc., until the last run or $b$ run of $b^{(n-1)} \cdot z/b$ sheets is marked in the 1st place of the sheet number with a number $h$ with the range of the numbers $c$ through $h$ corresponding to the numerical range of the numbers 0 through $b-1$;

forming $b$ groups (1) of sheets marked in the 1st place of the sheet number with each group (1) being identical by placing one part of $b^{(n-2)} \cdot z/b$ sheets marked with the number $c$ in the 1st numerical place into each of the $b$ groups (1); then placing one part of $b^{(n-2)} \cdot z/b$ sheets marked with $d$ in the 1st numerical place in each of the groups (1), etc., until one part of $b^{(n-2)} \cdot z/b$ sheets marked with $h$ in the 1st numerical place is placed in each of the $b$ groups (1) such that each of the $b$ groups (1) contains one part from each of the $b$ runs and each groups (1) contains a total of $b^{(n-1)} \cdot z/b$ sheets;

marking the 2nd numerical place of the sheet number on the sheets in one of the groups (1) with the number c;

marking separately the objects in succeeding groups (1) in the 2nd place of the sheet number with the numbers $d, e, f, g$, etc., used in marking the 1st place of the sheet number with numbers until the last group (1) is marked in the 2nd place of the sheet number with the same number $h$ used in marking the 1st numerical place of the sheet number;

forming $b$ identical groups (2), $b$ identical groups (3), $b$ identical groups (4) and so on until $b$ groups $(n-2)$ are formed by repeating the above procedures with each of the groups (2) formed by combining $b^2$ parts of $b^{(n-3)} \cdot z/b$ sheets from the marked groups (1), each of the groups (3) formed by combining $b^3$ parts of $b^{(n-4)} \cdot z/b$ sheets from the groups (2) and each of the groups (4) formed by combining $b^4$ parts of $b^{(n-5)} \cdot z/b$ sheets from the groups (3) and so on;

forming $b$ identical groups $(n-2)$, with each group $(n-2)$ containing $b^{(n-2)}$ parts and each part containing $z$ identically marked sheets;

marking the groups $(n-2)$ separately with the numbers $c$ through $h$ and then sorting the marked sheets by placing one of $z$ identically marked sheets into each of $z$ different groups $(n-1)$ which contain $b^{(n-1)}$ sheets, and then marking the nth numerical place of the sheet number of each of the groups $(n-1)$ with succeeding numbers from $c$ through $f$ corresponding to the numerical range of 0 to $z$ to provide $b^n \cdot z/b$ sheets which are separately marked with numbers corresponding to the numerical range from 0 to $b^n/z - 1$ by using a total of $b(n-1)+z$ marking steps, whereby each of the plurality of credit card areas on each sheet bears a unique number composed of the position number of the credit card area on the sheet and the sheet number of the particular sheet on which the particular credit card areas are defined and the number of sheets which are sorted into each of the $b$ groups after each marking, except for the last marking, is decreased by a factor of $1/b$ from the number of sheets sorted into each of the $b$ groups after the preceding marking operation.

10. The method of claim 9 wherein the numerical base $b$ ranges from about 4 to about 16.

11. The method of claim 9 wherein the credit card areas are marked by screen printing.

12. The method of claim 9 wherein the credit card areas are marked by altering the transmissivity of said sheets at selected areas on the sheets.

13. The method of claim 9 including the steps of providing a number of bins which is equal or greater than the numerical base, and sorting the sheets into *b* bins after each marking by placing one of *b* identical parts into each of the *b* bins.

14. The method of claim 13 wherein the number of bins is at least equal to twice the numerical base *b*, and including:

sorting the sheets into a first series of *b* bins after marking of one numerical place of the sheet number on the sheets;

marking the next numerical place of the sheet number on sheets drawn from the first series of *b* bins, and then sorting the thus marked sheets into the second series of *b* bins by placing one of *b* identical parts into each of the *b* bins in the second series of *b* bins.

15. The method of claim 9 wherein the sheets are alternatively sorted between a first series of *b* bins and a second series of *b* bins after marking of each numerical place of the sheet number on the sheets.

16. The method of claim 9 wherein the credit card areas are marked by forming holes at selected locations in the sheets.

* * * * *